US007457578B2

(12) United States Patent
Lundy et al.

(10) Patent No.: US 7,457,578 B2
(45) Date of Patent: Nov. 25, 2008

(54) BLADE BRUSH CLEANER

(75) Inventors: Douglas A. Lundy, Webster, NY (US); D Clay Johnson, Rochester, NY (US); Bruce J. Parks, Bloomfield, NY (US); Michael Quoc Lu, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 260 days.

(21) Appl. No.: 11/601,881

(22) Filed: Nov. 20, 2006

(65) Prior Publication Data

US 2007/0172275 A1 Jul. 26, 2007

Related U.S. Application Data

(63) Continuation-in-part of application No. 11/338,547, filed on Jan. 24, 2006.

(51) Int. Cl.
*G03G 21/00* (2006.01)

(52) U.S. Cl. ..... 399/349; 399/350; 399/353; 399/354; 399/355

(58) Field of Classification Search ..... 399/343, 399/344, 345, 346, 349, 350, 353, 354, 355, 399/358; 15/1.51, 256.5; 427/125, 145, 427/180, 430.1
See application file for complete search history.

(56) References Cited

U.S. PATENT DOCUMENTS

| | | | | |
|---|---|---|---|---|
| 5,257,079 | A | 10/1993 | Lange | |
| 5,416,572 | A * | 5/1995 | Kolb et al. | 399/350 |
| 5,600,425 | A * | 2/1997 | Thayer et al. | 399/353 |
| 5,732,320 | A * | 3/1998 | Domagall et al. | 399/350 |
| 7,362,996 | B2 * | 4/2008 | Facci et al. | 399/346 |

FOREIGN PATENT DOCUMENTS

JP 5-289593 * 11/1993

* cited by examiner

*Primary Examiner*—Hoan H Tran

(57) ABSTRACT

There is disclosed a system for cleaning marking material from a surface portion of a movable photoconductive member. The system includes a first rotatable brush, a blade and a second rotatable brush arranged in sequential order along the movable photoconductive member. The first rotatable brush is for removing a first amount of marking material from the surface portion of the movable photoconductive member as the surface portion of the movable photoconductive member moves past said first rotatable electrostatic brush. The blade, in engaging contact with the movable photoconductive member, is for removing a second amount of marking material from the surface portion of the movable photoconductive member. The second rotatable brush, positioned in interference contact with the movable photoconductive member, is for removing substantially all residual marking material that was not removed by the first rotatable brush and the blade.

20 Claims, 4 Drawing Sheets

BLADE BRUSH CLEANER

CROSS-REFERENCE TO RELATED APPLICATIONS

This application is a continuation-in-part of U.S. application Ser. No. 11/338,547, filed Jan. 24, 2006, entitled Blade Brush Cleaner, the entire disclosure of which is incorporated herein by reference.

FIELD OF THE INVENTION

The disclosed embodiments relate to an electrophotographic process, and more specifically to a photoconductor cleaning system useful in said process.

BACKGROUND OF THE INVENTION

In Xerography or an electrostatographic process, a uniform electrostatic charge is placed upon a photoreceptor surface. The charged surface is then exposed to a light image of an original to selectively dissipate the charge to form a latent electrostatic image of the original. The latent image is developed by depositing finely divided and charged particles of toner, or other acceptable marking material, upon the photoreceptor surface. The charged toner being electrostatically attached to the latent electrostatic image areas to create a visible replica of the original. The developed image is then usually transferred from the photoreceptor surface to a final support material, such as paper, and the toner image is fixed thereto to form a permanent record corresponding to the original.

In some Xerographic copiers or printers, a photoreceptor surface is generally arranged to move in an endless path through the various processing stations of the xerographic process. Since the photoreceptor surface is reusable, the toner image is then transferred to a final support material, such as paper, and the surface of the photoreceptor is prepared to be used once again for the reproduction of a copy of an original. In this endless path, several Xerographic related stations are traversed by the photoconductive belt.

Generally after the transfer station, a photoconductor cleaning station is next and it comprises an endless photoconduction belt which passes sequentially to a first cleaning brush, a second cleaning brush and after the brushes are positioned, a spots blade which is used to remove residual debris from the belt such as toner additive and other filming. This film is generally caused by the toner being impacted onto the belt by the cleaner brushes. When the lubrication of this blade is below a necessary level, it will abrade the belt. Toner is the primary lubricant for the blade; however a problem is with good cleaning efficiency by the cleaner brushes, the amount of toner reaching the blade can often be well below this necessary level. Without proper lubrication, this spots blade will seriously abrade the belt.

Since most toners used today are negatively charged, the embodiments throughout this disclosure and claims will be described relating to the use of a negative toner, however, when a positive toner is used, the proper opposite adjustments can easily be made.

The first brush above mentioned in prior art systems is responsible for nearly all of the filming on the photoconductive (PC) belt. This brush is positively charged to attract a negative charged toner and remove most of it from the PC belt. Adjacent to the first brush is a vacuum, which vacuums the toner from the brush for later disposal. Any toner that may have acquired a positive charge will pass by the first positively charged brush and will be picked up by the second brush, which is negatively charged. The vacuum is also adjacent to the second brush and should vacuum off the brush any residual positively charged toner. Then, as above noted, the spots blade scrapes off the belt any remaining toner debris or film layer. Again, after the action of the two prior cleaning brushes there is generally not sufficient toner lubrication for an effective action by this spots blade. The spots blade will remove the film layer comprised of toner additives that is caused by the impact of the first brush against the toner and PC belt. The serious problem that has been encountered in this type of prior art arrangement is, as noted, that the spots blade does not get enough toner provided lubrication and can easily scratch and damage the belt, causing a relatively high replacement rate for both the belt and the spots blade. In addition, copy quality begins to deteriorate as the PC belt is abraded and damaged or as the film is less effectively removed from the PC belt.

Some examples of prior art cleaning systems with multiple cleaning devices are disclosed in: U.S. Pat. No. 5,257,079 to Lange et al.; U.S. Pat. No. 5,729,815 to Lindblad et al.; and U.S. Pat. No. 6,775,512 B2 to Thayer. The pertinent portions of these three patents are incorporated herein by reference.

SUMMARY OF THE INVENTION

In a first aspect of the disclosed embodiments there is disclosed a system for cleaning marking material from a surface portion of a movable photoconductive member, the movable photoconductive member moving past a first location and then a second location, comprising: a first rotatable brush, positioned at the first location and adjacent the movable photoconductive member, for removing a first amount of marking material remaining on the surface portion of the movable photoconductive member as the surface portion of the movable photoconductive member moves past said first rotatable electrostatic brush; a blade, in engaging contact with the movable photoconductive member, for removing a second amount of marking material from the surface portion of the movable photoconductive member, said blade being positioned intermediate of the first and second locations; and a second rotatable brush positioned at the second location and in interference contact with the movable photoconductive member, said second brush removing substantially all residual marking material that was not removed by said first rotatable brush and said blade.

In a second aspect of the disclosed embodiments there is disclosed a cleaning system in which two cleaning brushes are used and a cleaning blade is positioned adjacent to the first brush. The first brush is charged in a manner that allows ample toner to pass through to the blade tip thus ensuring adequate lubrication at all times. The first brush is also used to transport toner from the blade tip to the vacuum channel. This second embodiment is further discussed in reference to FIG. 2 below described.

To summarize this second aspect of the disclosed embodiments, there is provided a PC belt cleaning system comprising in an operative arrangement a cleaning blade, two electrostatically charged brushes, the first brush has a negative charge and operatively located adjacent said cleaning blade. The second brush has a positive charge and is located in the system after said first brush and said cleaning blade. An entry shield is positioned below the first brush to capture loose toner falling from the brush or blade. The impact aspect in both embodiments and any other is that the cleaning blade be positioned in the cleaning system so that it gets proper toner lubrication to function effectively.

In a final aspect of the disclosed embodiments there is disclosed a method for cleaning marking material from a surface portion of a movable photoconductive member, the movable photoconductive member moving past a first location and then a second location, comprising: (A) using a first rotatable brush to remove a first amount of marking material remaining on the surface portion of the movable photoconductive member as the surface portion of the movable photoconductive member moves past said first rotatable electrostatic brush; (B) using a blade to remove a second amount of marking material from the surface portion of the movable photoconductive member, said blade being positioned intermediate of the first and second locations; and (C) using a second rotatable brush, in interference contact with the movable photoconductive member, for removing substantially all residual marking material that was not removed pursuant to (A) and (B).

DETAILED DISCUSSION OF DRAWINGS AND PREFERRED EMBODIMENTS

Figure 1:
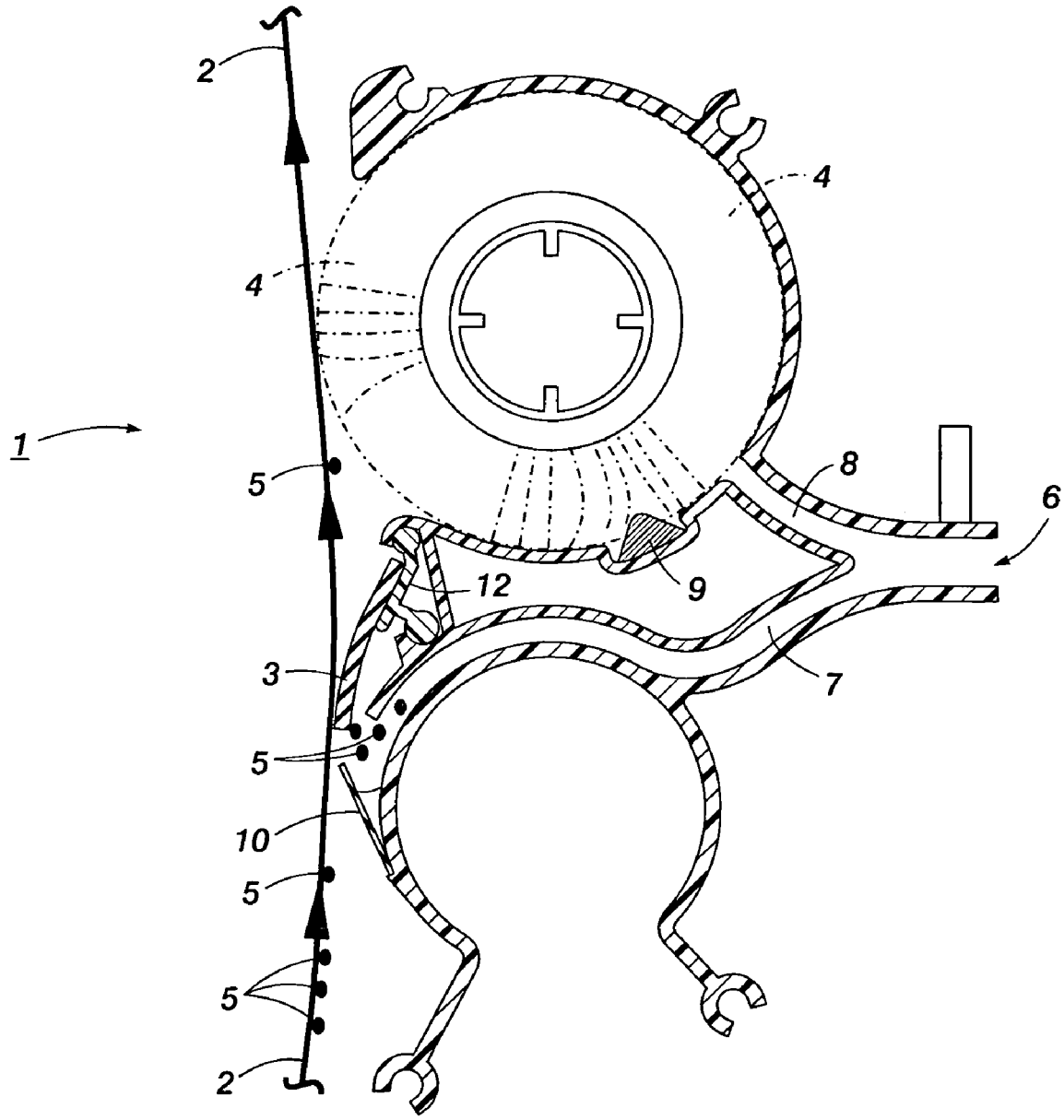
FIG. 1 is a planar view illustrating a first embodiment of a cleaning system herein described.

In FIG. 1, cleaning system 1 of an embodiment, a photoconductive belt 2 is shown, as it is adapted to move sequentially first to the cleaning blade 3, and then to an electrostatic brush 4. The arrows show the direction and path of the PC belt. The blade 3 is therefore upstream from the brush 4 and is the first cleaning component that contacts the belt. In this position blade 3 gets the proper toner induced lubrication since toner has not been previously removed by a brush 4 or any other component. The electrostatic brush 4 has a charge on it that is opposite to the charge on the toner 5 used in the system. This will permit brush 4 to attract the opposite charged toner 5 and remove any residual toner 5 not removed from the PC belt 2 by the cleaning blade 3. As above stated, since the cleaning blade 3 is the first cleaning component contacted by the belt 2, there is sufficient toner 5 on the belt at that point to provide ample lubrication for the blade 3 and minimize abrasion of the belt 2. The electrostatic brush 4 in system 1 follows the blade 3 to remove any residual toner 5. A vacuum unit 6 is positioned between the blade 3 and brush 4 to vacuum off any loose toner removed by either blade 3 or brush 4. After the toner is vacuumed out it can be disposed of by any suitable method. Vacuum air channels 7 and 8 are in air flow contact with the blade 3 and brush 4 respectively. A flicker bar 9 is in operative contact with brush 4 and is adapted to detone brush 4 together with vacuum unit 6. As toner 5 is flicked off brush 4 by flicker bar 9, it is picked up by the suction of vacuum channel 8 and transported out of system 1. Flicker bar 9 is positioned such that the fibers in the rotation brush 4 will contact the flicker bar 9 prior to reaching the vacuum channel 8; in FIG. 1, the flicker bar 9 is shown in a position consistent with a counterclockwise brush 4 rotation. Clockwise brush 4 rotation can also be used with the flicker bar 9 in a suitable position. An entry shield 10 is located below the cleaning blade 3 and directs loosened toner into vacuum channel 7 for removal from system 1. Toner 5 therefore is sequentially removed from photoconductor belt 2 by first contact with blade 3, which scrapes toner 5 off belt 2 and then by cleaner brush 4, which removes any residual toner by brush action together with electrostatic action (since it is biased oppositely to toner). The arrows 11 indicate the travel direction of belt 2, blade 3 is "upstream" and brush 4 is "downstream" as used in this disclosure.

Figure 2:
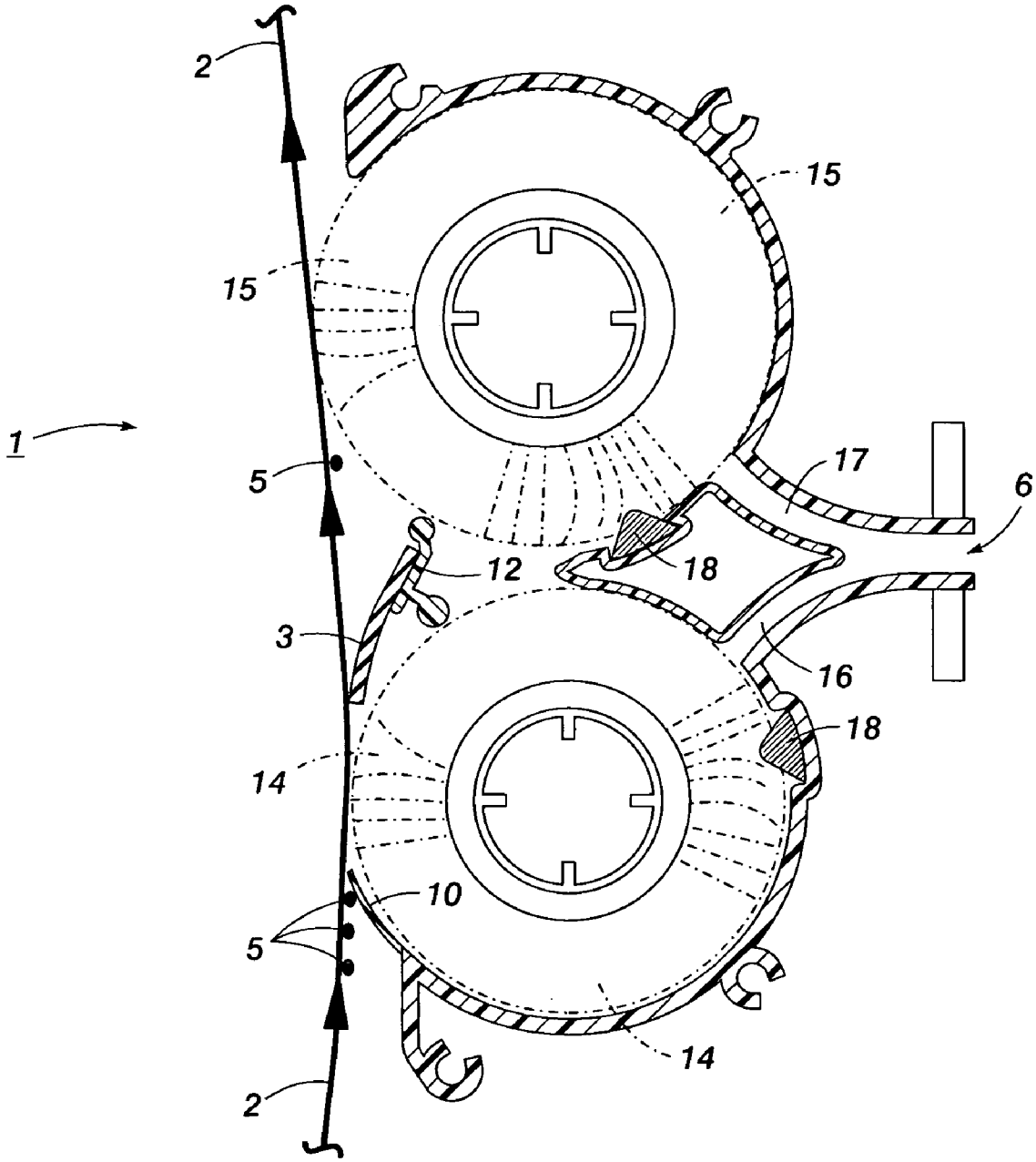
FIG. 2 is a planar view illustrating a second embodiment of the cleaning system herein described.

In FIG. 2, a second embodiment of the cleaning system described herein is illustrated. Two brushes 14 and 15 are used and a cleaning blade 3 is positioned adjacent to the first brush 14. The first brush 14 is charged in a manner that allows ample toner 5 to pass through to the blade tip 3, thus ensuring adequate lubrication at all times. A negative charge on the first brush 14 would remove any toner 5 that acquired a positive charge and allow all of the negatively charged toner 5 to pass through to the blade tip 3. Alternatively, a low positive charge on the first brush 14 would enable some level of cleaning of negatively charged toner 5 from the PC belt 2, if so desired, depending on the operating conditions at a given point in time. In either case, positive or negative charging of the first brush 14, the charge level would be such that ample toner is allowed to pass through to the blade tip 3. The first brush 14 is also used to transport toner 5 from the blade tip 3 to the vacuum channel 16. Another vacuum channel 17 is used to transport any residual loosened toner 5 from the second brush 15 to a vacuum collection means where it is disposed of. The second brush 15 can be charged positively or negatively to complement the polarity of the first brush 14. If the first brush 14 is negative to remove positively charged toner 5, the second brush 15 is positive to remove negatively charged toner 5 that was not removed by the blade tip 3. If the first brush 14 is positive to remove some negative toner 5, the second brush is negative to remove positively charged toner 5 that is not removed by the blade tip 3. If the Xerographic system is optimized in a manner to ensure only one polarity of toner arrives at the cleaning system 1, then both brushes 14 and 15 can be charged to the same polarity, that being opposite of the toner 5 polarity. The charge level on the first brush 14 would still be such that an ample amount of lubricating toner 5 would pass through to the blade tip 3. The flicker bars 18 positions are suitable for brushes that are rotating in a counter clockwise direction. The brush fibers hit the flicker bar 18, which compresses the fibers. Then as the fibers open up, they are exposed to the vacuum channels 16, 17 for toner removal. Obviously, if the brushes 14 and 15 were rotating clockwise, the flicker bars 18 would be shown in a different location (preceding the vacuum channels 16 and 17). An entry shield 10 is positioned below the first brush 14 to capture loose toner 5 falling from the brush 14 or blade 3.

Figure 3:
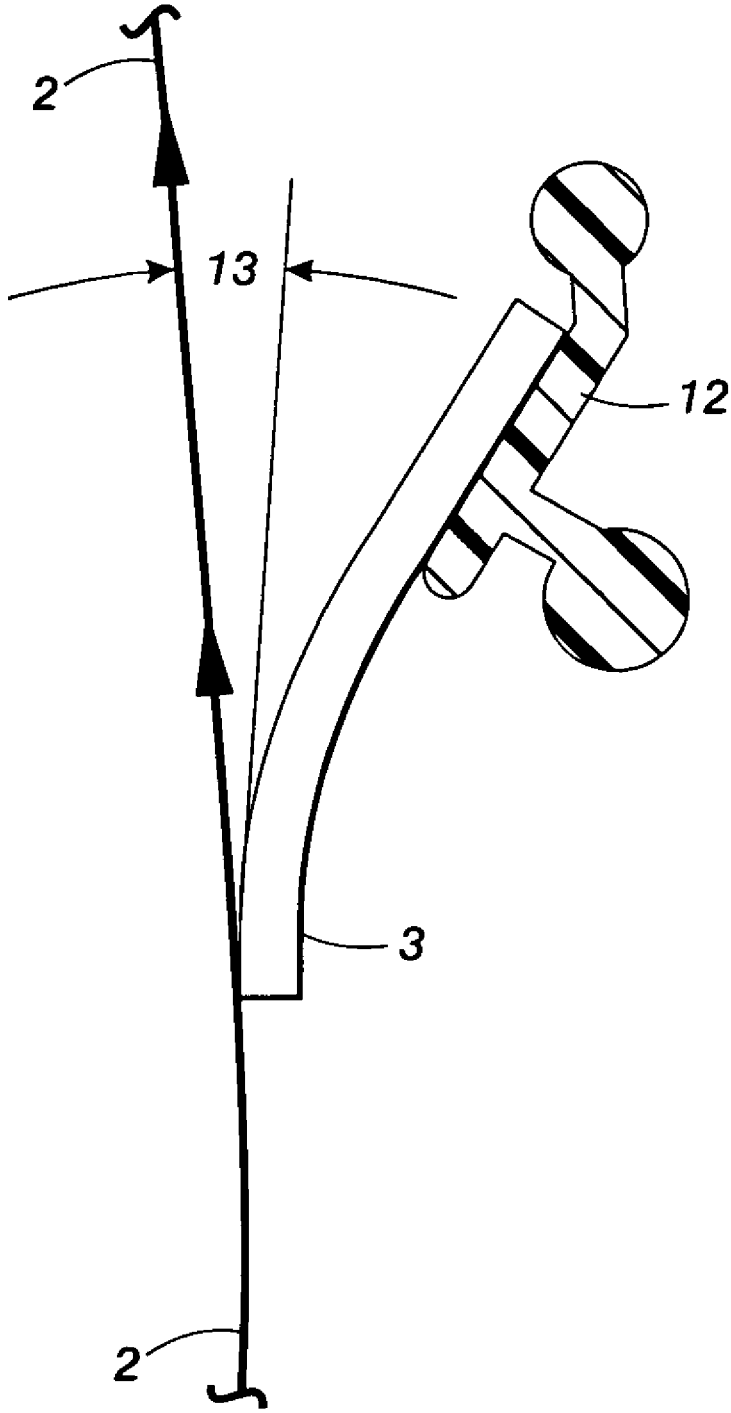
FIG. 3 is a planar view illustrating an embodiment of a movable cleaning blade as contacting a photoconductive belt.

In FIG. 3, the cleaning blade 3 of an embodiment is shown in an expanded view as it contacts PC belt 2. A movable or floating support 12 for the cleaning blade 3 permits proper movement and support for blade 3 as it contacts PC belt 2. While any suitable angle of contact 13 between the PC belt 2 and the blade 3 may be used, an angle of from 5 to 30 degrees has been found to be effective; however, any suitable and effective angle may be used. This system of FIG. 3 can be used in the embodiments of FIGS. 1 and 2 and any other embodiments.

Figure 4:
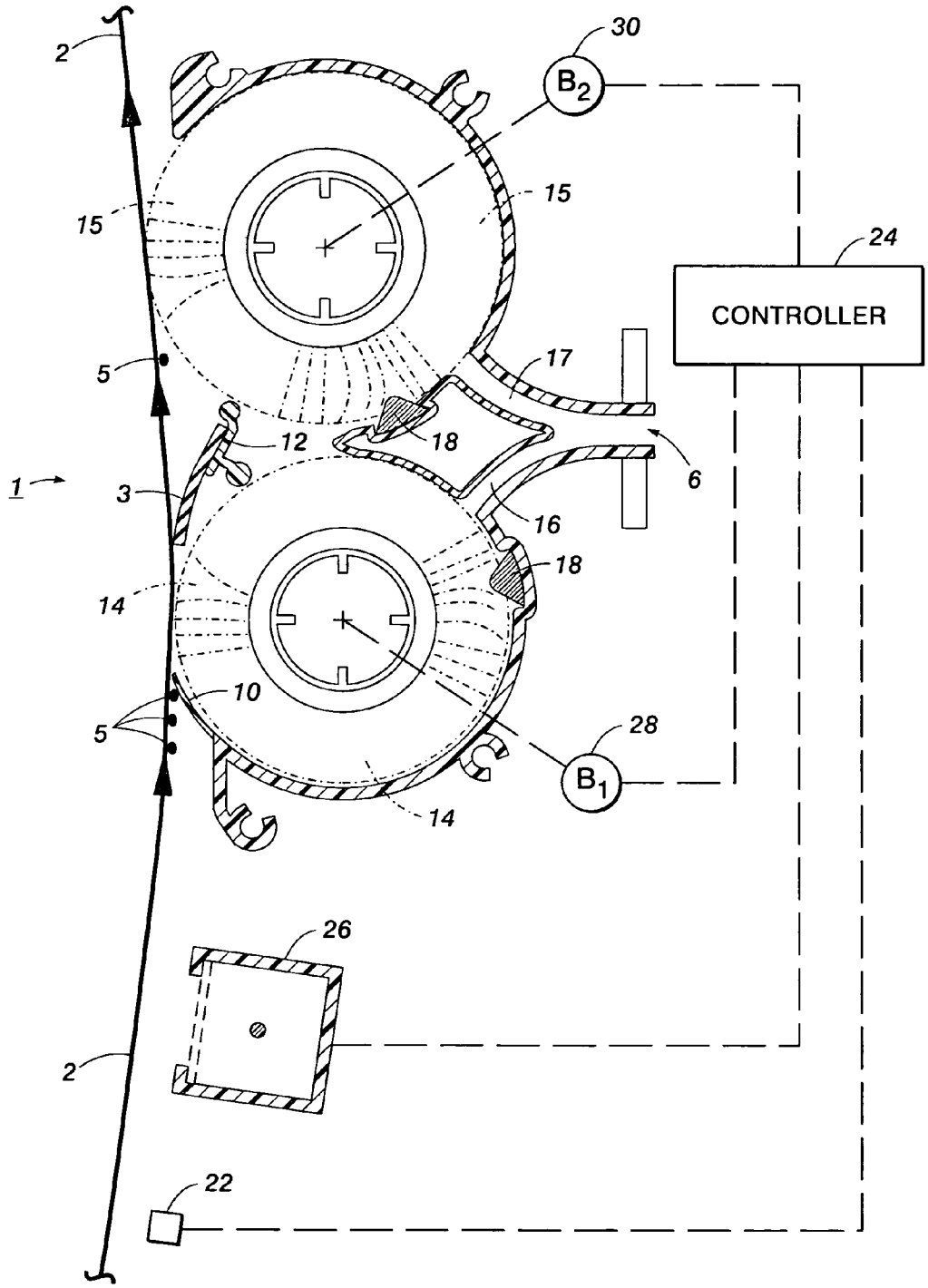
FIG. 4 is a planar view illustrating further detailed aspects of the second embodiment of FIG. 2.

Referring now to FIG. 4, further details associated with the second embodiment of FIG. 2 are shown. Starting from a point upstream of first brush 14, a toner area coverage (TAC) sensor, positioned adjacent the PC belt 2, is designated by the numeral 22. As is known the amount of toner on the PC belt 2 can vary as a function of toner area coverage associated with a given toned image. The TAC sensor communicates with a conventional controller, designated by the numeral 24, to provide an area coverage compensation subsystem, the details of which are described in further below. An example of a cleaning system with TAC sensing is described in U.S. Pat. No. 5,960,228 to Budnik et al, the pertinent portions of which are incorporated herein by reference.

Referring still to FIG. 4, a pre-clean corona, positioned adjacent a surface of the PC belt 2 and communicating with the controller 24, is designated by the numeral 26. In one example, the pre-clean corona is controlled with the controller 24 to set a given charge of residual toner on the surface of the PC belt 2. As contemplated, the given charge is set at a level to optimize cleaning with system 1. Further details regarding the operation of the pre-clean corona is taught by U.S. Pat. No. 6,775,512 B2 to Thayer.

One exemplary approach of charging or biasing the brushes is shown in FIG. 4 as being achieved with conventional charging subsystems 28 ($B_1$) and 30 ($B_2$). B1 and B2 communicate with the controller 24, the controller being used to set the respective biases or charges of brushes 14 and 15. Further teachings regarding brush biasing can be obtained by reference to U.S. Pat. No. 5,729,815.

Referring specifically to brush 14 of FIG. 4, in one possible example of operation, little interference between brush 14 and the PC belt 2 is required since the brush 14 merely transports loosened toner, obtained from scraping of the PC belt 2 with the blade 3, toward the vacuum channel 16. A certain amount of interference is shown between the brush 15 and the PC belt 2. As is understood by those skilled in the art, some interference facilitates cleaning while too much interference leads to premature belt failure. In one example, it has been found that 2 mm of interference between the brush 15 and the belt 2 leads to acceptable levels of toner residue cleaning. In one example, the suitable interference between the second brush 15 and the PC belt 2 (in which suitable removal of toner residual is achieved and wear on the belt is minimized) was determined through empirical investigation.

In accordance with the area coverage detected with the TAC sensor 22, the bias of brush 14 could be increased or decreased. For instance, assuming use of negatively charged toner, the bias of brush 14 could, at one time, be increased with the controller 24 in response to a first signal at the controller 24 (from the TAC sensor 22) indicating an increase in toner area coverage, and decreased, at another time, in response to a second signal indicating a decrease in toner area coverage. As should now be evident, the area coverage compensation subsystem can be used to "trim" toner with respect to the cleaning blade 3 by adjusting the bias at $B_1$, while maintaining the bias constant at $B_2$.

Described above are photoconductive (PC) cleaning systems comprising in an operative arrangement, a movable PC belt, at least one electrostatically charged cleaning brush, and a cleaning blade. The cleaning blade is positioned upstream in said system and located therein prior to one electrostatically charged brush, said PC belt is adapted to travel to said cleaning blade before it contacts a later cleaning brush positioned in said system subsequent to said cleaning blade. The cleaning blade is adapted to scrape toner off said PC belt and be lubricated by said toner prior to contacting said later brush. At least one of said electrostatically charged brush present in said system will remove charged toner from said PC belt.

In addition to the features described or suggested above, the disclosed cleaning system contemplates the following:

Adjustable interference exists between at least a first of two rotatable brushes and a movable photoconductive member. The interference may be adjusted in such a way as to permit an amount of marking material sufficient to lubricate a blade to be provided to the blade.

The photoconductive member moves from an upstream position to a downstream position, while the first rotatable brush is positioned at a location downstream of the upstream position. Additionally, the marking material has a settable charge. The cleaning system includes an adjustable pre-clean corona positioned upstream of the location and adjacent the movable photoconductive member. The adjustable pre-clean corona can be adjusted to set the settable charge of the marking material, and thereby optimize operability of the cleaning system.

A settable bias signal may be applied to the first rotatable brush, and the bias signal may be set in such a way as to assist in permitting an amount of marking material sufficient to lubricate the blade to be provided to the blade.

In operation, a selected amount of marking material is applied to a surface of the movable photoconductive member upstream of the first rotatable brush. A settable bias signal, varying as a function of the selected amount of marking material, may then be applied to the first rotatable brush.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be. encompassed by the following claims.

What is claimed is:

1. A system for cleaning marking material from a surface portion of a movable photoconductive member, the movable photoconductive member moving past a first location and then a second location, comprising:

a first rotatable brush, positioned at the first location and adjacent the movable photoconductive member, for removing a first amount of marking material from the surface portion of the movable photoconductive member as the surface portion of the movable photoconductive member moves past said first rotatable electrostatic brush;

a blade, in engaging contact with the movable photoconductive member, for removing a second amount of marking material from the surface portion of the movable photoconductive member, said blade being positioned intermediate of the first and second locations; and a second rotatable brush positioned at the second location and in interference contact with the movable photoconductive member, said second brush removing substantially all residual marking material that was not removed by said first rotatable brush and said blade.

2. The cleaning system of claim 1, in which the marking material possesses a first charge and said second rotatable brush possesses a second charge, wherein the difference in the first charge and the second charge is great enough to cause at least some of the marking material not removed by said first rotatable brush and said blade to be attracted to said second rotatable brush.

3. The cleaning system of claim 2, wherein the first charge is substantially opposite the second charge.

4. The cleaning system of claim 1, wherein said second rotatable brush operatively follows said blade to remove substantially all marking material not removed by said first rotatable brush and said blade.

5. The cleaning system of claim 1, further comprising a vacuum system, operatively associated with said blade and said second rotatable brush, for removing any marking material loosened by said blade or said second rotatable brush.

6. The cleaning system of claim 5, wherein said vacuum system includes a first air flow channel and a second air flow channel, and wherein said first air flow channel is in operative vacuuming air flow relationship with said blade and said second air flow channel is in operative vacuuming air flow relationship with said second rotatable brush.

7. The cleaning system of claim 5, wherein said vacuum system includes a first air flow channel and a second air flow channel, and wherein said first air flow channel is in operative vacuuming air flow relationship with said first rotatable brush and said second air flow channel in operative vacuuming air flow relationship with said second rotatable brush.

8. The cleaning system of claim 1, in which interference exists between said first rotatable brush and the movable photoconductive member, and in which the interference between said first rotatable brush and the movable photoconductive member is adjustably settable, wherein the interference between said first rotatable brush and the movable photoconductive member is set in such a way as to permit an amount of marking material sufficient to lubricate said blade to be provided to said blade.

9. The cleaning system of claim 1, in which interference between said second rotatable brush and the movable photoconductive member is adjustably settable, wherein the interference between said second rotatable brush and the movable photoconductive member is set in such a way that substantially all residual marking material is removed by said second rotatable brush and wear on the photoconductive member, resulting from said interference between said second rotatable brush and the movable photoconductive member is substantially minimized.

10. The cleaning system of claim 1, further comprising an entry shield, wherein said entry shield is operatively positioned, relative to said blade, to capture loose marking material falling from said blade.

11. The cleaning system of claim 1, in which the marking material corresponds with a settable charge, and in which the movable photoconductive member moves from a position upstream of the first location to a position downstream of the second location, further comprising an adjustable pre-clean corona positioned upstream of said first location and adjacent the movable photoconductive member, wherein said adjustable pre-clean corona is adjusted to set the settable charge of the marking material.

12. The cleaning system of claim 1, in which a settable bias signal is applied to said first rotatable brush, the settable bias signal being set in such a way as to assist in permitting an amount of marking material sufficient to lubricate said blade to be provided to said blade.

13. The cleaning system of claim 1, in which (a) the movable photoconductive member moves from a position upstream of the first location to a position downstream of the second location (b) a part of the movable photoconductive member surface portion is marked upstream of said first rotatable brush with a selected amount of marking material, and (c) a settable bias signal is applied to said first rotatable brush, wherein the settable bias signal is set as a function of said selected amount of marking material.

14. A photoconductive belt cleaning system comprising in an operative arrangement a PC belt movable from a location, a cleaning blade, a vacuum unit and two electrostatic cleaning brushes, a first of said cleaning brushes having a first charge with a first polarity and being operatively positioned adjacent said cleaning blade, a second of said cleaning brushes having a second charge with a second polarity and positioned sequentially after the location of said first cleaning brush and said cleaning blade, said first cleaning brush having the first charge with the first polarity being enabled to remove toner having the second charge with the second polarity from said PC belt, said second cleaning brush having the second charge with the second polarity being enabled to remove toner having the first charge with the first polarity from said PC belt, said PC belt enabled to lubricate said cleaning blade by contacting said cleaning blade with lubricating toner carried by said PC belt and wherein said vacuum unit is operatively connected to said first and second cleaning brushes by air flow vacuum channels adapted to transport loosened toner from said first and second brushes to a toner disposal point.

15. The system of claim 14 wherein said first cleaning brush is positively charged and said second cleaning brush is negatively charged.

16. The system of claim 14 further comprising a first flicker bar and a second flicker bar, wherein said first and second cleaning brushes are detoned respectively by first and second flicker bars located in operative contact therewith.

17. The system of claim 14 further comprising an entry shield, wherein said entry shield is positioned near said first cleaning brush for capturing loose toner falling from said cleaning blade.

18. A method for cleaning marking material from a surface portion of a movable photoconductive member, the movable photoconductive member moving past a first location and then a second location, comprising:

(A) using a first rotatable brush to remove a first amount of marking material remaining on the surface portion of the movable photoconductive member as the surface portion of the movable photoconductive member moves past said first rotatable electrostatic brush;

(B) using a blade to remove a second amount of marking material from the surface portion of the movable photoconductive member, said blade being positioned intermediate of the first and second locations; and (C) using a second rotatable brush, in interference contact with the movable photoconductive member, for removing substantially all residual marking material that was not removed pursuant to (A) and (B).

19. The method of claim 18, in which interference exists between the first rotatable brush and the movable photoconductive member, and in which the interference between the first rotatable brush and the movable photoconductive member is adjustably settable, further comprising:

(D) setting the interference between the first rotatable brush and the movable photoconductive member in such a way as to permit an amount of marking material sufficient to lubricate the blade to be provided to said blade.

20. The method of claim 18, in which (1) the movable photoconductive member moves from a position upstream of the first location to a position downstream of the second location (2) a part of the movable photoconductive member surface portion is marked upstream of the first rotatable brush with a selected amount of marking material, and (3) a settable bias signal is applied to said the rotatable brush, further comprising:

(D) setting the settable bias signal as a function of the selected amount of marking material.

* * * * *